US005885141A

United States Patent [19]

Watkin

[11] Patent Number: 5,885,141

[45] Date of Patent: Mar. 23, 1999

[54] PORTABLE BLAST WHEEL CLEANING MACHINE

[75] Inventor: Robert B. Watkin, Peachtree City, Ga.

[73] Assignee: United States Filter Corporation, Palm Desert, Calif.

[21] Appl. No.: 900,900

[22] Filed: Jul. 25, 1997

[51] Int. Cl.[6] ..... B24C 3/06

[52] U.S. Cl. ..... 451/92; 451/27; 451/28

[58] Field of Search ..... 451/91, 92, 93, 451/88, 89, 75, 87, 86, 904

[56] References Cited

U.S. PATENT DOCUMENTS

| | | | |
|---|---|---|---|
| 3,566,543 | 3/1971 | Fogle . | |
| 3,900,969 | 8/1975 | Diehn . | |
| 4,020,596 | 5/1977 | Bergh . | |
| 4,319,436 | 3/1982 | Van Fossen . | |
| 4,433,511 | 2/1984 | Swain | 451/92 |
| 4,894,959 | 1/1990 | Hoover | 451/92 |
| 5,007,210 | 4/1991 | Urakami | 451/92 |
| 5,161,337 | 11/1992 | Swain | 451/92 |
| 5,231,805 | 8/1993 | Sander | 451/92 |
| 5,231,806 | 8/1993 | Swain | 451/92 |
| 5,285,601 | 2/1994 | Watkin et al. . | |
| 5,291,697 | 3/1994 | Nelson | 451/88 |
| 5,441,443 | 8/1995 | Roberts | 451/92 |
| 5,498,197 | 3/1996 | Roberts et al. | 451/92 |

*Primary Examiner*—Timothy V. Eley
*Assistant Examiner*—Derris Holt Banks
*Attorney, Agent, or Firm*—Wolf, Greenfield & Sacks, P.C.

[57] ABSTRACT

An apparatus for blast cleaning a generally vertical surface is disclosed. The device features a blast cabinet containing a blast wheel rotatably mounted about a horizontal axis. The blast wheel is positioned adjacent to an opening in the cabinet through which it propels abrasive material against the vertical surface being cleaned. Rebounding abrasive again contacts the rotating blast wheel. This contact deflects the particulate through a rebound corridor, to the side and into-a filter. The abrasive then falls into a storage hopper for reuse. A conveyor is rotatably mounted so as to catch leaked particulate matter. The conveyor features a pair of opposing feed screws that meet in the middle of the conveyor so that leaked particulate matter is projected up to the blast wheel in a manner similar to a water fountain. The particulate matter is then propelled by the blast wheel to the rebound corridor.

22 Claims, 4 Drawing Sheets

PORTABLE BLAST WHEEL CLEANING MACHINE

BACKGROUND OF THE INVENTION

1. Field of the Invention

The invention relates generally to surface treating machines and, more particularly, to an improved portable blast machine for cleaning substantially vertical surfaces.

2. Description of the Related Art

Blast cleaning machines typically consist of a blast wheel having a plurality of blades extending radially therefrom. The blast wheel is mounted in a housing and is rotatably driven at high speed. Abrasive such as steel shot is fed onto the blades and is projected against the surface to be cleaned. The impact of the abrasive with the surface to be cleaned dislodges paint, rust and other debris from the surface. Typically, the debris is removed from the system and the spent abrasive is recirculated back to the blast wheel. The housing is typically moved along over the surface to be cleaned.

A particularly useful application of portable blast cleaning machines is the cleaning of large vertical surfaces, such as the outer side walls of a ship's hull or a large tank for storing water, gas or the like. Such portable blast machines are usually suspended by cables from a movable hoist positioned above the vertical surface. The hoist raises and lowers the device vertically and moves horizontally so that the device may traverse the vertical surface.

Examples of such machines are presented by Diehn, U.S. Pat. No. 3,900,969; Bergh, U.S. Pat. No. 4,020,596; and Van Fossen, U.S. Pat. No. 4,319,436. The machines disclosed by these patents all feature a blasting wheel that projects abrasive upwardly at the vertical surface. The abrasive rebounds off of the vertical surface, taking the debris that was removed from the surface, such as paint and rust, and dust with it. The rebounding mixture of abrasive, debris and dust enters a rebound passage and then a filtering passage where it is exposed to an air stream that removes the debris and dust but leaving the heavier abrasive. The separated debris and dust are carried away by the air stream for deposit in a drum on the ground while the abrasive falls into a hopper within the device where it is returned to the blast wheel for reuse.

A disadvantage of such designs is that the angled orientation of the blast wheel and the rebound chamber limit the compactness of the devices. More specifically, in order for the blast wheel to project the abrasive against the vertical surface at the proper angle, it must be oriented and spaced a certain distance away from and below the portion of the vertical surface being treated. Furthermore, a somewhat lengthy chamber must lead from the blast wheel to the vertical surface. In addition, the rebound passage must be nearly perpendicular to the initial blast path. These requirements lead to devices having V-shaped housings that are not space efficient.

A device that is more space efficient is desirable in that it would be more compact and lightweight. This would allow the device to be more easily transported, carried and handled. For example, a lighter duty, and thus less expensive, hoist could be used to raise and lower the device. A more compact device could also more easily and thoroughly access confined spaces such as comers and portions of the vertical surface that are close to the ground. In addition, due to its compact design, such a machine could be manufactured at a lower material cost. As such, it is an object of the present invention to provide an improved portable blast wheel cleaning machine that is compact and lightweight.

In the use of portable blast machines to clean vertical surfaces, it is desirable to confine the space about the surface being treated to permit recovery of abrasive and to prevent the development of hazardous conditions resulting from the ricocheting of particulate material into the surrounding atmosphere. In a portable device that is being moved over a vertical surface, the device housing obviously cannot be permanently attached to the surface to effect the desired sealing relation. As a result, flexible seals made of rubber or polyurethane are often deployed around the blast opening of the device so as to be positioned between the device housing and the vertical surface. Such seals are limited in effectiveness, however, by uneven vertical surfaces and wear of the seals themselves.

Accordingly, it is desirable to have a system whereby particulate material that leaks from the seals may be recovered. As such, it is a further object of the present invention to provide an improved portable blast wheel cleaning machine wherein particulate which escapes the seals may be recovered.

SUMMARY OF THE INVENTION

The present invention is directed to an improved portable blast wheel cleaning machine for cleaning a generally vertical surface with an abrasive material. The machine is compact and lightweight and features a system for reclaiming leaked particulate matter. The machine has a blast cabinet containing a blast chamber, with a blast opening that overlays the vertical surface to be cleaned, and a rebound corridor that is positioned above the blast chamber. A blast wheel is rotatably disposed about a generally horizontal axis within the blast cabinet and propels abrasive material through the blast opening and against the vertical surface.

Thereafter, the blast wheel also serves to propel abrasive material, that has rebounded off of the vertical surface, upwardly into the rebound corridor for recovery. The rebounding abrasive carries with it the debris removed from the surface, such as paint and rust, as well as dust. The mixture of rebounded abrasive, debris and dust passes up through the rebound corridor until it is deflected by a baffle placed in the upper end of a rebound corridor. The deflected mixture then comes to rest in a filter. As the mixture flows through a spreader slot in the filter, an air flow carries away the lighter debris and dust so that the separated abrasive material falls into a hopper for reuse.

A floating seal surrounds the blast opening and contacts the vertical surface when the blast machine is in use. A conveyor housing is positioned vertically below the floating seal. The conveyor housing has a center portion with a passage in communication with the blast chamber proximate to the blast wheel. A lower lip is attached to the conveyor housing so that particulate matter that escapes the floating seal is directed into the conveyor housing.

A conveyor is disposed about a generally horizontal axis within the conveyor housing. The conveyor features a pair of opposing feed screws that meet in the center of the housing. As a result, abrasive material collected within the conveyor housing is transferred to the center portion of the housing where it is forced upwardly through the passage and fed to the blast wheel in a manner similar to a water fountain. The abrasive material is propelled by the blast wheel up into the rebound corridor where it mixes in with the flow of rebounding abrasive.

For a more complete understanding of the nature and scope of the invention, reference may now be had to the following detailed description of embodiments thereof taken in conjunction with the appended claims and accompanying drawings.

DETAILED DESCRIPTION OF THE INVENTION

Figure 1:
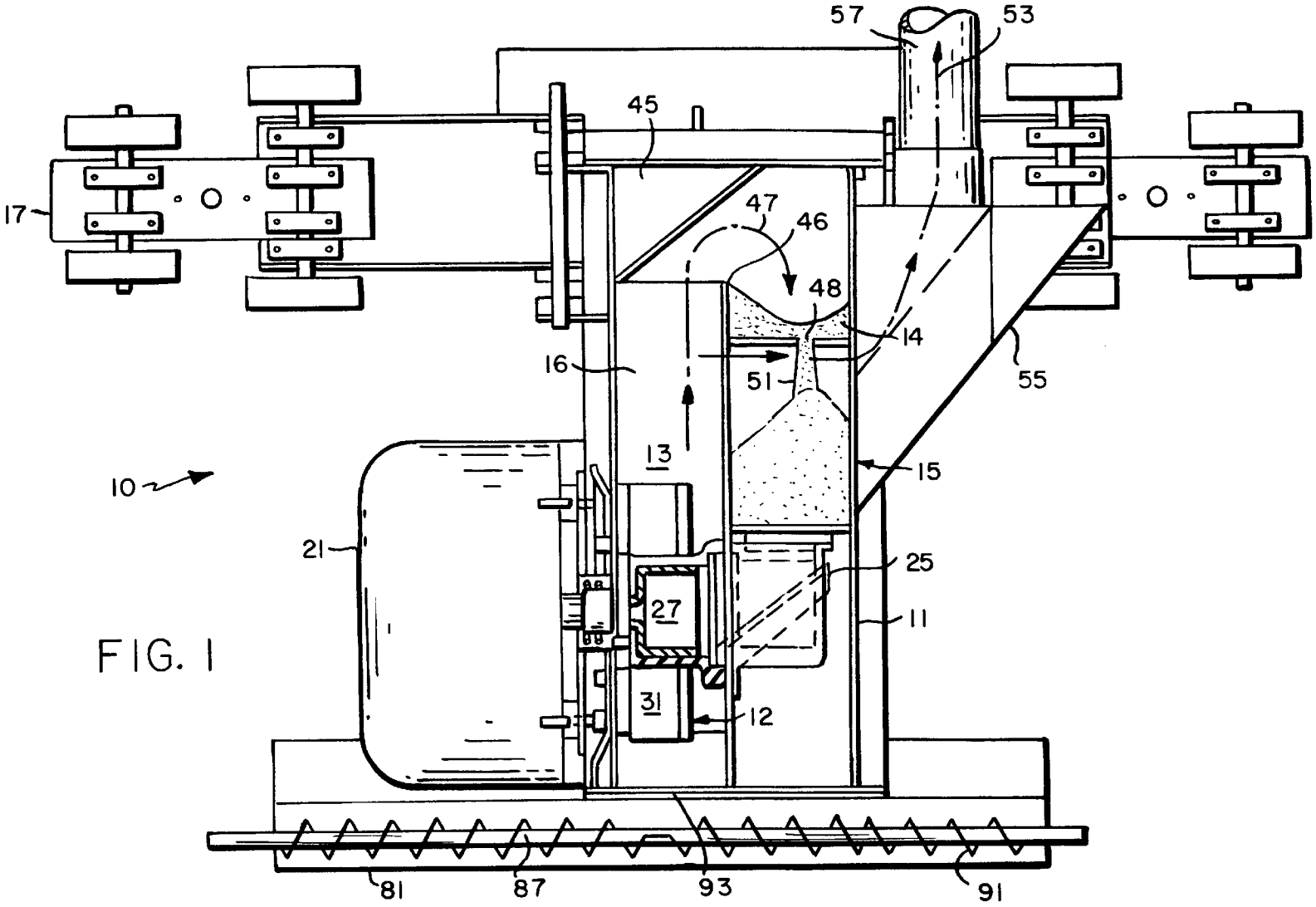
FIG. 1 is a partial cut away rear view of an embodiment of a blast wheel machine.

Referring to FIG. 1, an embodiment of the portable blast wheel machine of the present invention is indicated generally at 10. The machine features a blast cabinet 11 containing a blast wheel 12, a blast chamber 13, filter 14 and storage hopper 15. Blast chamber 13 features rebound corridor 16. Blast cabinet 11 is connected at its upper portion to carriage 17. Carriage 17 features a magnetic traction drive system so that it, and thus blast cabinet 11, may move horizontally along a vertical ferromagnetic surface. Such magnetic traction drive systems are known in the art. An example of a suitable drive may be found in U.S. Pat. No. 5,286,601 to Watkin et al. Connected to the side of blast cabinet 11 is motor 21 which rotates blast wheel 12 and powers the magnetic traction drive system for carriage 17.

In operation, abrasive material is fed from storage hopper 15, through feed passage 25 to hub 27 in the center of blast wheel 12. Such blasting wheels are well known in the art and feature a plurality of circumferentially spaced blades 31 which extend radially out from the hub 27. Abrasive material is fed onto the inner ends of the blades 31 and is displaced along the blades in response to rapid rotational movement of blast wheel 12. Upon reaching the ends of blades 31, the abrasive material is thrown at high velocity onto the surface to be treated. Depending somewhat upon the type of surface treatment, the abrasive material may be steel shot, steel grit or similar abrasive materials.

Figure 2:
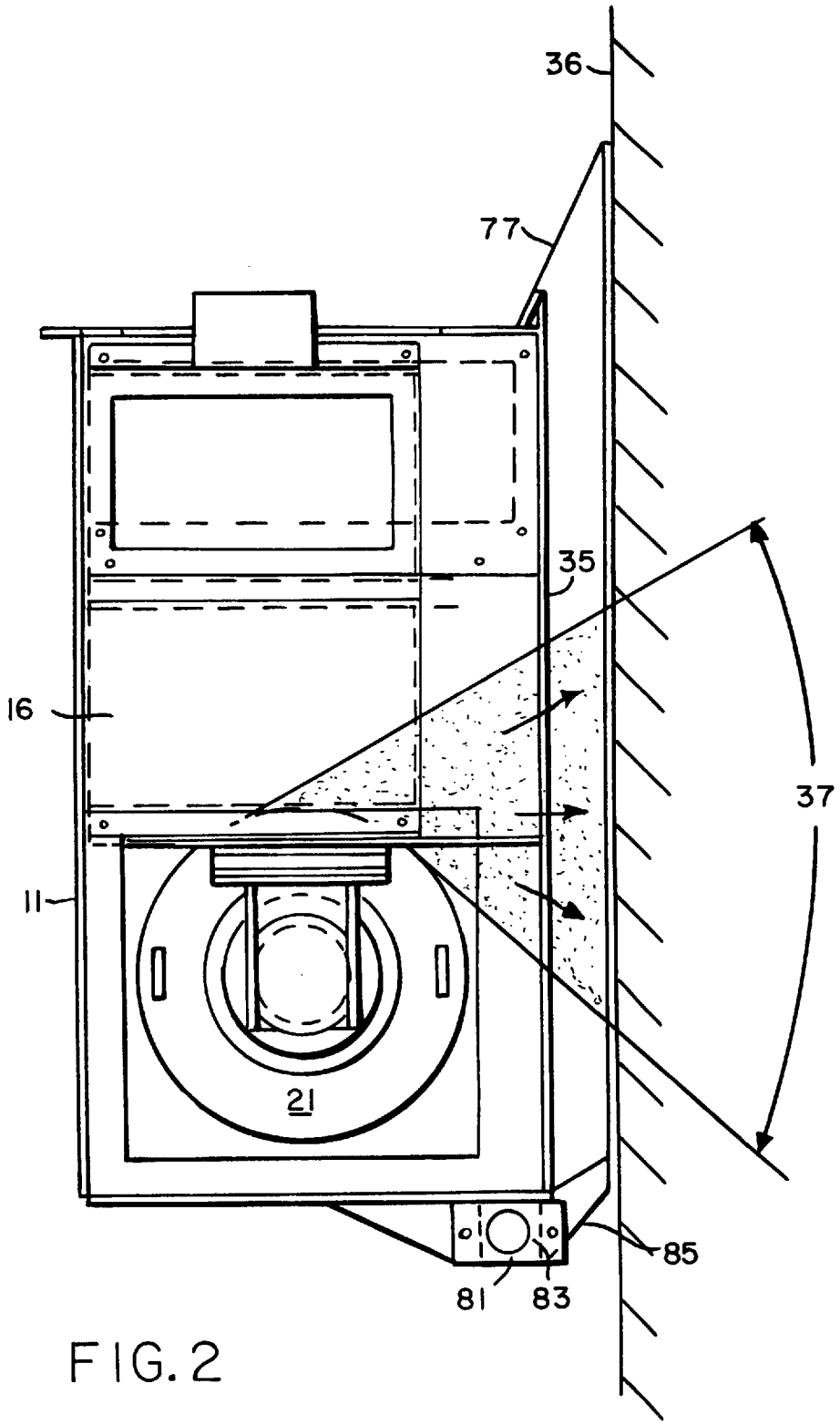
FIG. 2 is a side view of the blast wheel machine of FIG. 1, without the carriage, showing the blast pattern made by the abrasive as it is propelled against a vertical surface.
Figure 3:
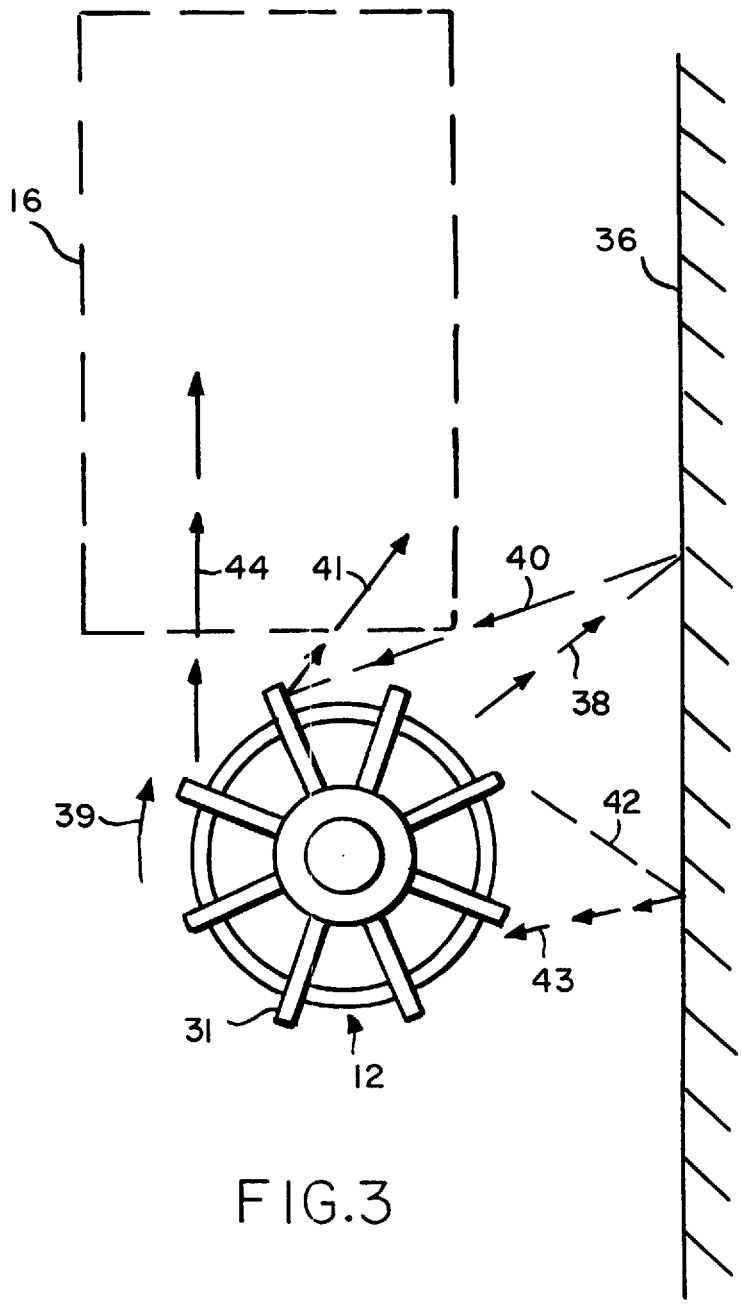
FIG. 3 is a simplified view showing only the blast wheel and illustrating the typical paths of the rebounding abrasive.

Referring to FIG. 2, the abrasive material, propelled by blast wheel 12, projects through blast opening 35 of blast cabinet 11 and onto the vertical surface 36 so as to form blast pattern 37. Arrows 38 of FIG. 3 show the path of representative abrasive particles as they travel to vertical surface 36 after being propelled by blast wheel 12, which is rotating in the direction shown by arrow 39. As shown by arrows 40, after striking the vertical surface, the rebounding abrasive material, mixed with dust and the debris, travels back towards blast wheel 12 as particulate material.

The particulate material collides with one of the blades 31 of blast wheel 12 which deflects the mixture upwards into rebound corridor 16, as indicated by arrows 41. The abrasive is thus subjected to a "second hit" by the blades 31 of blast wheel 12. This action, when combined with the turbulence from the rotating blast wheel 12, creates a flow of the particulate material vertically upwardly through rebound corridor 16. Abrasive particles that are propelled by, and rebound towards, blast wheel 12 at an angle lower than arrows 38 and 40, as represented by arrows 42 and 43, are carried around the blast wheel 12 by blades 31 and are also propelled upwards into the rebound corridor 16 as shown by arrows 44. It may require several impacts with the blades 31 to propel the rebounding abrasive into the rebound corridor, but eventually this will occur.

This flow of particulate material continue through rebound corridor 16 until it is deflected by a baffle, shown at 45 in FIG. 1. The deflected flow of particulate material then passes over a divider wall 46 and comes to rest in filter 14. This flow path is indicated by arrow 47.

Filter 14 features a spreader slot 48 through which the particulate material flows. This flow of particulate material, indicated at 51, is subjected to an air stream, indicated by arrows 53, that separates the relatively light dust and debris from the abrasive. This process is commonly known as air-wash separation and the separated dust and debris flows out of the blast housing via exhaust housing 55 and vacuum hose 57 as illustrated in FIG. 1. Air flow 53 is created by a dust collector cart, shown at 61 in FIG. 3, which contains an air pump as is known in the art. After the filtering process, the abrasive falls into storage hopper 15, within blast cabinet 11, where it is once again fed—to blast wheel 12 for reuse.

As shown in FIG. 2, blast opening 35 is surrounded by floating seal 77. During operation of the blast machine, floating seal 77 is pressed against the vertical surface being cleaned so as to prevent the escape of most of the particulate material.

As shown in FIGS. 1 and 2, a conveyor housing, 81, is attached to the bottom portion of blast cabinet 11, beneath blast opening 35 and floating seal 77. Conveyor housing 81 features an opening 83 bordered underneath and on its sides by lower lip 85. Lower lip 85 functions so as to direct particulate material, that has leaked out of floating seal 77, into opening 83 of conveyor housing 81. Conveyor housing 81 contains a conveyor 87 which rotates about a horizontal axis via a simple drive system and motor 21. Conveyor 87 features a screw feed having a pair of opposing feed screws 91 that meet in the middle of conveyor 87. As a result, once the particulate material enters opening 83, it is forced to the center of housing 81 where it is forced upwardly, in a manner similar to a water fountain, through a passage 93, which leads from conveyor housing 81 into blast cabinet 11, and into the path of the rotating blast wheel 12. This particulate material is then propelled by blast wheel 12 up into rebound corridor 16 where it joins the flow of particulate material rebounding from the vertical surface. This arrangement minimizes the escape of dust and debris while maximizing the amount of reclaimed abrasive.

Figure 4:
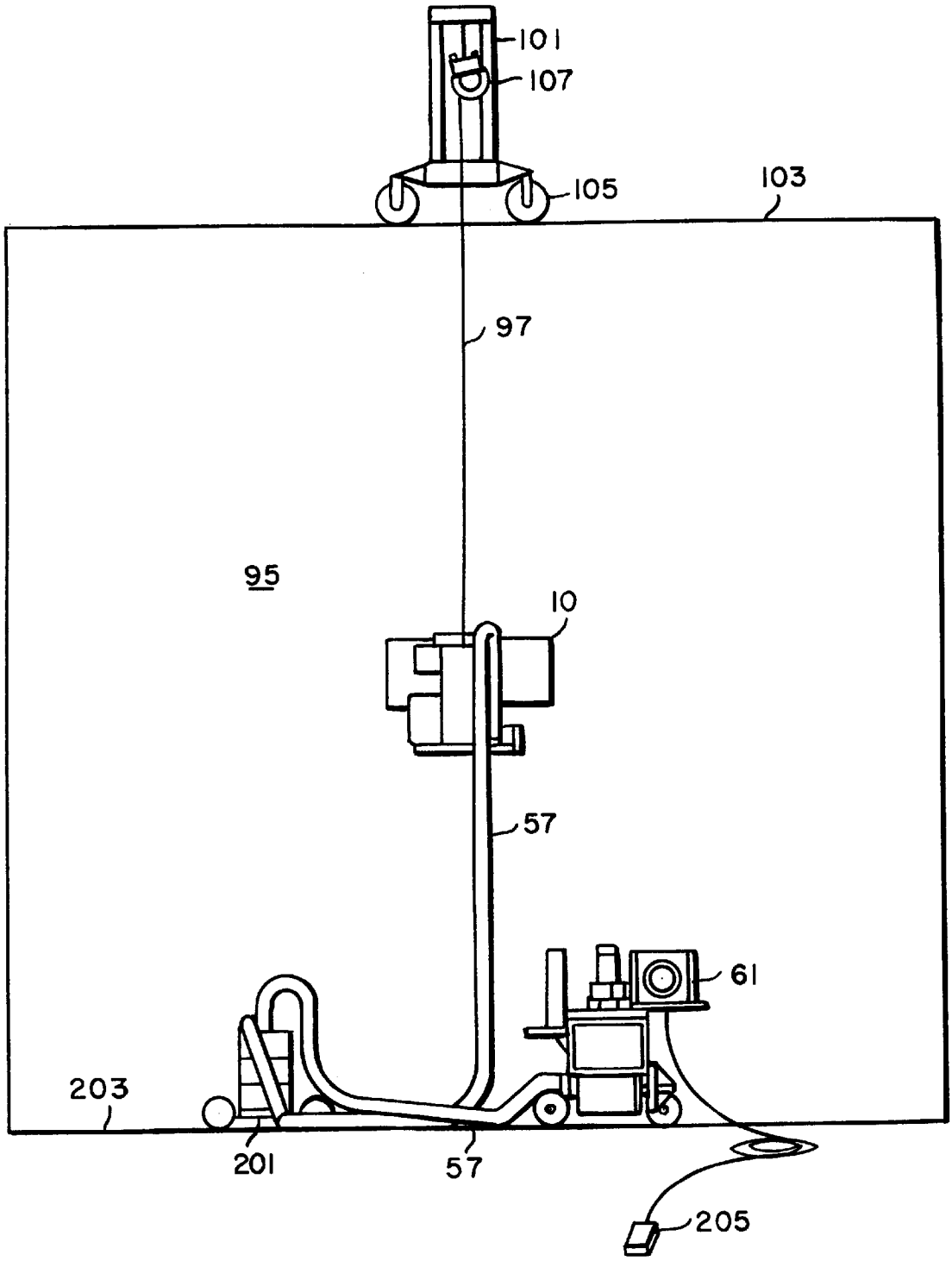
FIG. 4 shows a system, featuring the blast wheel machine of FIGS. 1 and 2, being used to clean the sidewall of a large storage tank.

Referring to FIG. 4, the machine of FIGS. 1–3 is shown as part of a system that is being used to clean the exterior side walls of a large storage tank 95. The portable blast cleaning machine 10 is suspended by a cable 97 from a hoist system 101 that is movably deployed upon the top surface 103 of tank 95 via wheels 105. Hoist system 101 moves horizontally in sync with blast machine 10 via a drive system that powers wheels 105. Such drive systems are well known in the Hoist system 101 is mounted to a boom-like support fixture, not shown, which pivots from the center of the tank. Hoist system 101 includes a cable drum and drive arrangement 107 which raises and lowers the blast machine 10 via cable 97. The cable drum is grooved to assure proper tracking of cable 97.

Also shown in FIG. 4 is vacuum hose 57 which leads from the blast machine 10 to cyclone cart 201 and then to dust collector cart 61. Cyclone cart 201 and dust collector cart 61 are usually positioned on ground surface 203. Particulate material, such as paint, rust and dust, that is removed from the housing through vacuum hose 57, via the air flow generated by dust collector cart 61, is deposited in a 55 gallon drum positioned upon cyclone cart 201. The drum of cyclone cart 201 may be emptied when fall. In addition to the air pump mentioned previously, dust collector cart 61 also houses a filtering system and the electrical control panel for the entire system. A remote hand held operators station 205 is provided for hoist and blast machine operations. Dust collector cart 61 is light weight so that it may be pulled along the ground by the operator as the cleaning progresses. The system typically may be operated by one person with occasional assistance to reposition the hoist, move around protrusions, etc.

While the preferred embodiments of the invention have been shown and described, it will be apparent to those skilled in the art that changes and modifications may be made therein without departing from the spirit of the invention, the scope of which is defined by the appended claims.

What is claimed is:

1. A portable apparatus for treating a generally vertical surface with an abrasive, comprising:

a) a blast cabinet defining:

i) a blast chamber having an opening, said opening overlying the vertical surface to be treated;

ii) a storage hopper containing a supply of abrasive; and iii) a rebound corridor in communication with the blast chamber and said storage hopper;

b) a blast wheel rotatably disposed about a generally horizontal axis within said blast cabinet for initially propelling said abrasive through said opening and against said vertical surface, said blast wheel also functioning to propel abrasive rebounding from the vertical surface upwardly into said rebound corridor;

c) said storage hopper positioned to receive the rebounding abrasive and to feed said abrasive to said blast wheel;

d) a conveyor housing positioned below said blast cabinet and adapted to receive abrasive which escapes from said blast cabinet, said conveyor housing having a center portion with a passage in communication with said blast cabinet; and e) a conveyor with a screw feed within said conveyor housing arranged so that abrasive material collected within said conveyor housing is transferred to the center portion thereof and forced upwardly through said passage into contact with said blast wheel.

2. The portable apparatus of claim 1 further comprising a floating seal surrounding the opening of said blast chamber and abutting said vertical surface.

3. The portable apparatus of claim 1 further comprising a baffle disposed within said rebound corridor to deflect the rebounding abrasive back into the storage hopper.

4. The portable apparatus of claim 1 further comprising a filter in communication with said rebound corridor and said storage hopper for filtering the rebounded abrasive.

5. The portable apparatus of claim 4 wherein the filter includes:

a) a spreader slot through which an abrasive flow occurs;

b) a dust collector;

c) a vacuum hose in communication with the blast housing and the dust collector; and d) means for creating an airflow for transferring dust from said abrasive flow to said dust collector through said vacuum hose.

6. The portable apparatus of claim 1 further comprising means for supporting the blast cabinet for traversing the vertical surface.

7. The portable apparatus of claim 6 wherein the means for supporting the blast cabinet for traversing the vertical surface comprises a plurality of wheels attached to said blast cabinet.

8. The portable apparatus of claim 1 further comprising a hoist system attached to said blast cabinet for raising and lowering the portable apparatus as it travels along the vertical surface.

9. The portable apparatus of claim 1 further comprising a lower lip attached to said conveyor housing and abutting said vertical surface.

10. A portable apparatus for treating a generally vertical surface with an abrasive, comprising:

a) a blast cabinet defining:

i) a blast chamber having an opening, said opening overlying the vertical surface to be treated;

ii) a storage hopper containing a supply of abrasive; and iii) a rebound corridor in communication with the blast chamber and said storage hopper;

b) a blast wheel rotatable disposed about a generally horizontal axis within said blast cabinet for initially propelling said abrasive through said opening and against said vertical surface, said blast wheel also functioning to propel abrasive rebounding from the vertical surface upwardly into said rebound corridor; and c) said storage hopper positioned to receive the rebounding abrasive and to feed said abrasive to said blast wheel.

11. The portable apparatus of claim 10 further comprising a floating seal surrounding said opening and abutting said vertical surface.

12. The portable apparatus of claim 10 further comprising a baffle disposed within said rebound corridor to deflect the rebounding abrasive back into the storage hopper.

13. The portable apparatus of claim 10 further comprising a filter in communication with said rebound corridor and said storage hopper for filtering the rebounded abrasive.

14. The portable apparatus of claim 13 further comprising:

a) a spreader slot through which an abrasive flow occurs;

b) a dust collector;

c) a vacuum hose in communication vath the blast housing and the dust collector; and d) means for creating an airflow for transferring dust from said abrasive flow to said dust collector through said vacuum hose.

15. The portable apparatus of claim 10 further comprising means for supporting the blast cabinet for traversing the vertical surface.

16. The portable apparatus of claim 15 wherein the means for supporting the blast cabinet for traversing the vertical surface comprises a plurality of wheels attached to said blast cabinet.

17. The portable apparatus of claim 10 further comprising a hoist system attached to said blast cabinet for raising and lowering the portable apparatus as it travels along the vertical surface.

18. A portable apparatus for treating a generally vertical surface with an abrasive, comprising:

a) a blast wheel for projecting the abrasive towards the vertical surface being treated;

b) a blast cabinet containing said blast wheel;

c) a conveyor housing positioned below said blast cabinet and adapted to receive abrasive which escapes from said blast cabinet, said conveyor housing having a center portion with a passage in communication with said blast cabinet; and d) a conveyor with a screw feed within said conveyor housing arranged so that abrasive material collected within said conveyor housing is transferred to the center portion thereof and forced upwardly through said passage into contact with said blast wheel.

19. The portable apparatus of claim 18 further comprising means for supporting the blast cabinet for traversing the vertical surface.

20. The portable apparatus of claim 18 wherein the means for supporting the blast cabinet for traversing the vertical surface comprises a plurality of wheels attached to said blast cabinet.

21. The portable apparatus of claim 18 further comprising a hoist system attached to said blast cabinet for raising and lowering the portable apparatus as it travels along the vertical surface.

22. The portable apparatus of claim 18 further comprising a lower lip attached to said conveyor housing and abutting said vertical surface.

* * * * *